US005524646A

United States Patent [19]

Reich

[11] Patent Number: 5,524,646

[45] Date of Patent: Jun. 11, 1996

[54] CIGAR/CIGARETTE HOLDER

[76] Inventor: Gregory H. Reich, 567 Blandon Rd., Fleetwood, Pa. 19522-9377

[21] Appl. No.: 552,715

[22] Filed: Nov. 3, 1995

[51] Int. Cl.[6] ..... A24F 15/00; A24F 15/18

[52] U.S. Cl. ..... 131/329; 131/256; 131/257

[58] Field of Search ..... 131/329, 187, 131/175, 178, 190, 256, 257; D27/102-104, 136

[56] References Cited

U.S. PATENT DOCUMENTS

| | | | |
|---|---|---|---|
| D. 177,867 | 5/1956 | Keulman | 131/257 |
| D. 196,219 | 9/1963 | McKinney | D27/104 |
| 282,183 | 7/1883 | Fletcher | 131/257 |
| 1,840,255 | 1/1932 | Rinne | 131/256 |
| 1,936,431 | 1/1933 | Halapleus | 131/257 X |
| 2,736,322 | 2/1956 | Ford | 131/256 |
| 3,173,641 | 3/1965 | Dorrance | 131/256 X |
| 3,994,308 | 11/1976 | Pancer | 131/256 |

*Primary Examiner* Jennifer Bahr

[57] ABSTRACT

A cigar/cigarette holder for allowing a user to temporarily secure a cigar or a cigarette to a proximal object including a clamp having a pair of arms positioned in opposition about a common axis of symmetry and a spring mechanism for biasing the arms toward each other; a container for holding a plurality of cigars or cigarettes; a coupling mechanism for removably coupling the container to the clamp and for allowing axial rotation of the arms about the common axis of symmetry; and a plurality of generally parallel and connected tubes coupled to the container for removably holding cigars or cigarettes.

8 Claims, 3 Drawing Sheets

FIG 3
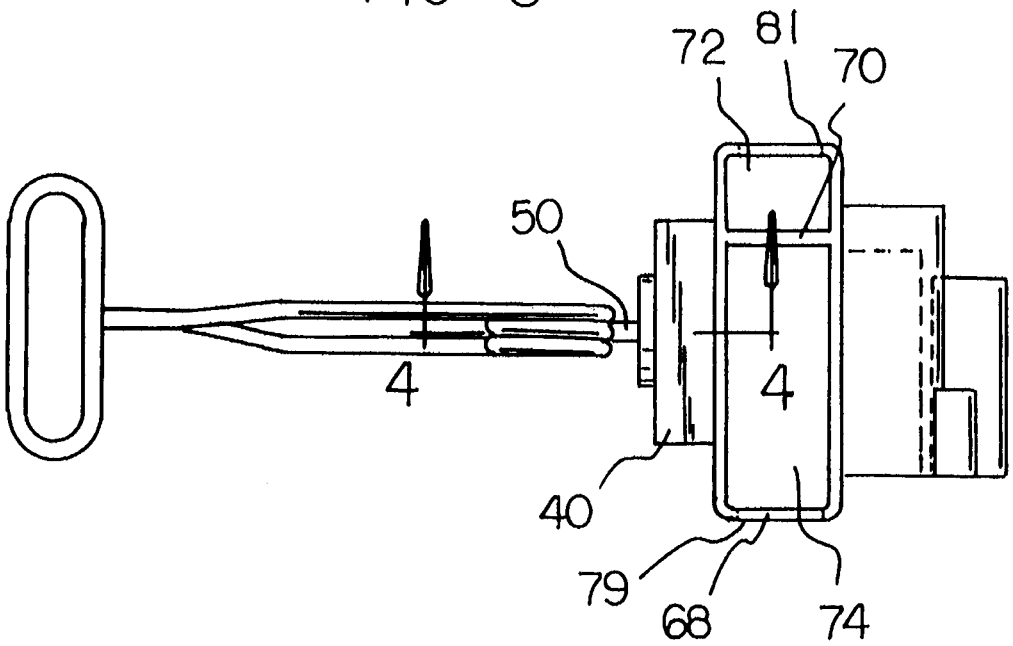
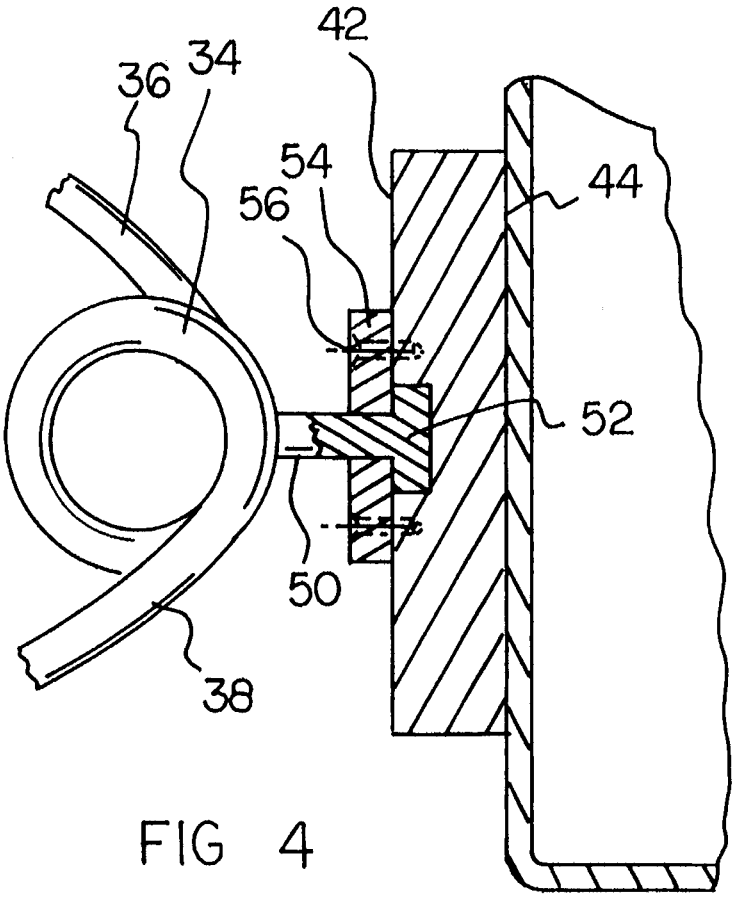
FIG 4

FIG 5
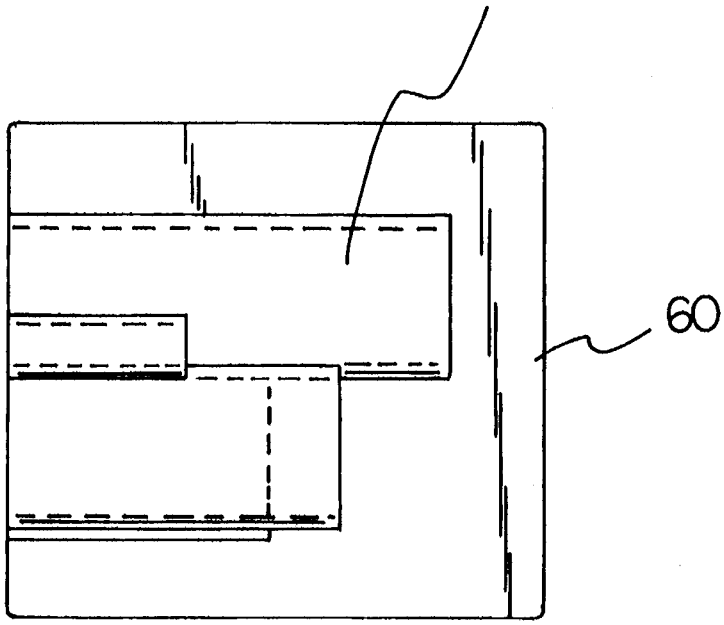
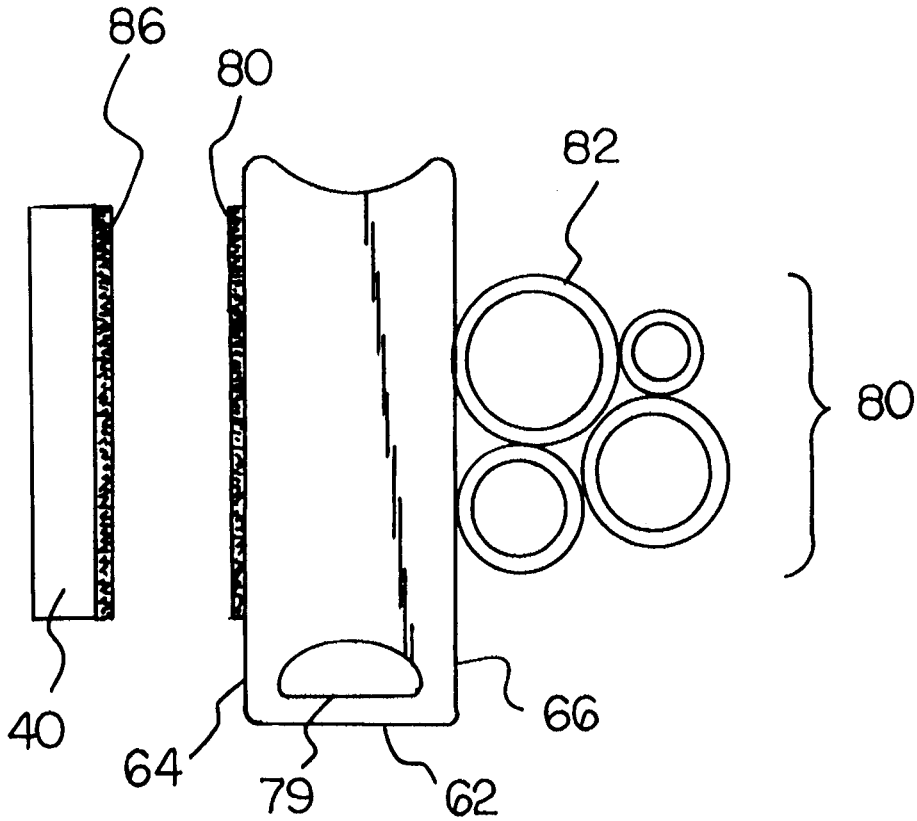
FIG 6

CIGAR/CIGARETTE HOLDER

BACKGROUND OF THE INVENTION

1. Field of the Invention

The present invention relates to a cigar/cigarette holder and more particularly pertains to allowing a user to temporarily secure a cigar or a cigarette to a proximal object with a cigar/cigarette holder.

2. Description of the Prior Art

The use of cigar/cigarette holders is known in the prior art. More specifically, cigar/cigarette holders heretofore devised and utilized for the purpose of holding cigars or cigarettes are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 300,417 to Knecht discloses a combined upper handle bar clamp and cigar lighter holder for a motorcycle. U.S. Pat. No. 3,921,645 to Hagman discloses a safety cigarette holder. U.S. Pat. No. 3,978,981 to Musick discloses a lighted cigar holder. U.S. Pat. No. 4,685,477 to Valdez discloses a cigar or cigarette holder. U.S. Pat. No. 4,711,254 to Fleisher et al. discloses a cigar holder. U.S. Pat. No. 5,226,647 to Notarmuzi discloses a multi-purpose golfer's accessory.

While these devices fulfill their respective, particular objective and requirements, the aforementioned patents do not describe a cigar/cigarette holder that is simple in design, readily transportable, and allows a cigar, cigarette, or combination thereof to be held at a proximal location for use.

In this respect, the cigar/cigarette holder according to the present invention substantially departs from the conventional concepts and designs of the prior art, and in doing so provides an apparatus primarily developed for the purpose of allowing a user to temporarily secure a cigar or a cigarette to a proximal object.

Therefore, it can be appreciated that there exists a continuing need for new and improved cigar/cigarette holder which can be used for allowing a user to temporarily secure a cigar or a cigarette to a proximal object. In this regard, the present invention substantially fulfills this need.

SUMMARY OF THE INVENTION

In the view of the foregoing disadvantages inherent in the known types of cigar/cigarette holders now present in the prior art, the present invention provides an improved cigar/cigarette holder. As such, the general purpose of the present invention, which will be described subsequently in greater detail, is to provide a new and improved cigar/cigarette holder and method which has all the advantages of the prior art and none of the disadvantages.

To attain this, the present invention essentially comprises, in combination, a clamp. The clamp includes a pair of opposed arms that are positioned in facing opposition about a common axis of symmetry. Each arm is formed of a wire. Each arm also has an inboard segment extending away from the common axis of symmetry, an outboard segment extending in parallel with the common axis of symmetry, and an intermediate segment extended therebetween such that the inboard segment and the intermediate segment of each arm define a generally L-shaped configuration. The clamp includes a pair of grasping ends. Each grasping end is formed of a wire bent into a continuous and generally elliptical shape. Each grasping end is coupled to one of the outboard segments of one of the arms. The clamp includes a centrally disposed circular spring that is positioned between the arms. The spring has a first end integral with the inboard segment of one of the arms and a second end integral with the inboard segment of the other arm. The grasping ends of the clamp are offset from each other when a compressive force is applied to the ends. The grasping ends are symmetrically aligned and placed in facing contact when the compressive force is removed. The clamp includes a rigid and generally rectangular box-shaped mounting block. The mounting block has parallel and offset inboard and outboard surfaces. A pin is also included. The pin has outboard end affixed to the spring and an inboard end pivotally coupled to the inboard surface of the block to thereby allow axial rotation of the arms in unison about the common axis of symmetry.

A rigid, rectangular, and generally box-shaped container is provided. The container has a bottom wall with an inboard wall, an outboard wall, and a pair of opposing side walls extended upwards from the bottom wall to define a hollow interior. A divider wall is included and extended between the inboard and outboard walls to define a first compartment sized for holding a cigarette lighter and a second compartment sized for holding a pack of cigarettes or a plurality of unlit cigars. The container also has a concave-shaped upper edge extent that defines a seat upon which an individual cigar or cigarette may be placed. A first generally oval aperture is formed in the side wall of the container adjacent to the first compartment at a lower extent thereof for draining fluids therefrom. A second generally oval aperture is formed in the side wall of the container adjacent to the second compartment at a lower extent thereof for draining fluids therefrom.

A cigarette/cigar holding mechanism formed of a plurality of parallel and connected tubes is included. The cigarette/cigar holding mechanism is coupled to the outboard wall of the container. The tubes of the cigarette/cigar holding mechanism have slightly different interior diameters. Each tube is adapted to snugly and removably hold an individual lit cigar or cigarette. Lastly, a strip of pile-type fastener is affixed to the outboard surface of the mounting block, and a complimentary strip of pile-type fastener is affixed to the inboard wall of the container. The strips are removably secured to each other for removably coupling the container to the clamp.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cigar/cigarette holder which has all the advantages of the prior art cigar/cigarette holders and none of the disadvantages.

It is another object of the present invention to provide a new and improved cigar/cigarette holder which may be easily and efficiently manufactured and marketed.

It is a further object of the present invention to provide a new and improved cigar/cigarette holder which is of durable and reliable construction.

An even further object of the present invention is to provide a new and improved cigar/cigarette holder which is susceptible of a low cost of manufacture with regard to both materials and labor, and which accordingly is then susceptible of low prices of sale to the consuming public, thereby making such a cigar/cigarette holder economically available to the buying public.

Still yet another object of the present invention is to provide a new and improved cigar/cigarette holder which provides in the apparatuses and methods of the prior art some of the advantages thereof, while simultaneously overcoming some of the disadvantages normally associated therewith.

Even still another object of the present invention is to provide a new and improved cigar/cigarette holder for allowing a user to temporarily secure a cigar or a cigarette to a proximal object.

Lastly, it is an object of the present invention to provide a new and improved cigar/cigarette holder comprising a clamp having a pair of arms positioned in opposition about a common axis of symmetry and spring means for biasing the arms toward each other; a container for holding a plurality of cigars or cigarettes; coupling means for removably coupling the container to the clamp and for allowing axial rotation of the arms about the common axis of symmetry; and a plurality of generally parallel and connected tubes coupled to the container for removably holding cigars or cigarettes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the preferred embodiment of the present invention.

FIG. 4 is a cross-Sectional view of the present invention taken along the line 4—4 of FIG. 3.

FIG. 5 is a side-elevational view of the container of the present invention with the cigar/cigarette holder affixed thereto.

FIG. 6 is a view of the removable coupling of the container of the present invention with the clamp of the present invention.

The same reference numerals refer to the same parts through the various Figures.

DESCRIPTION OF THE PREFERRED EMBODIMENT

Figure 1:
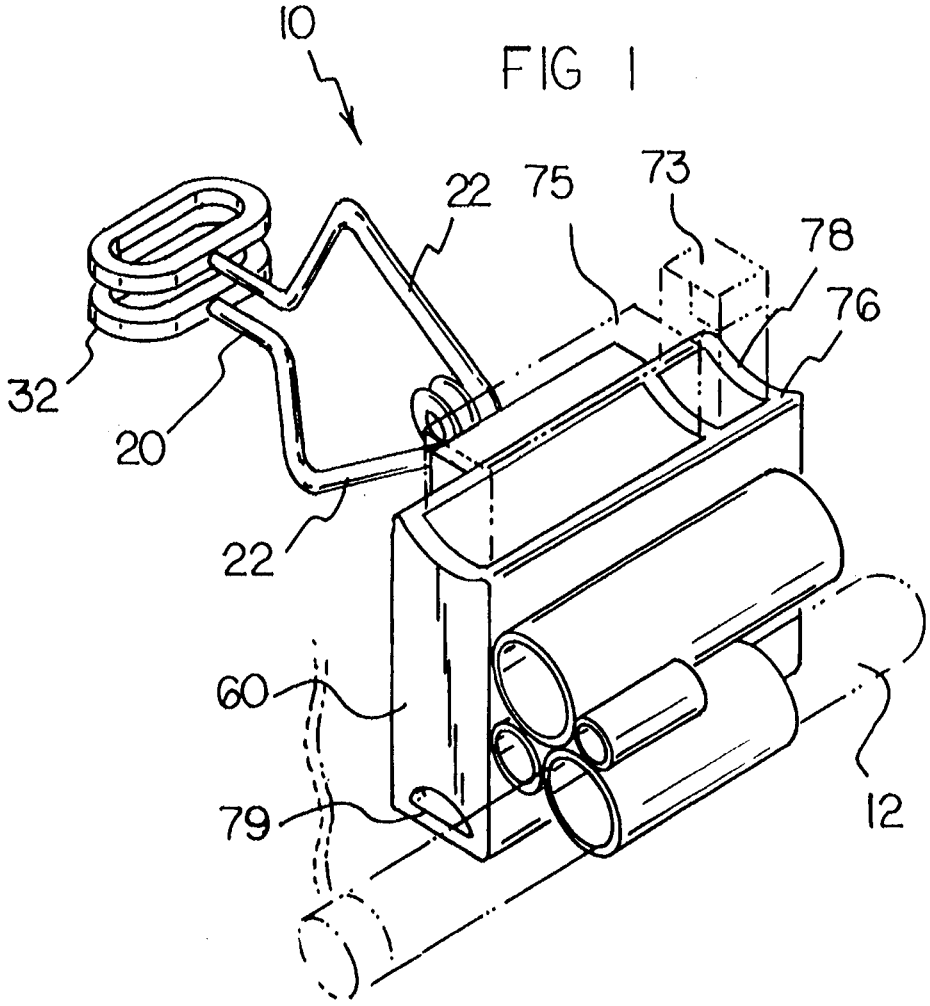
FIG. 1 is a perspective view of the preferred embodiment constructed in accordance with the principles of the present invention.
Figure 2:
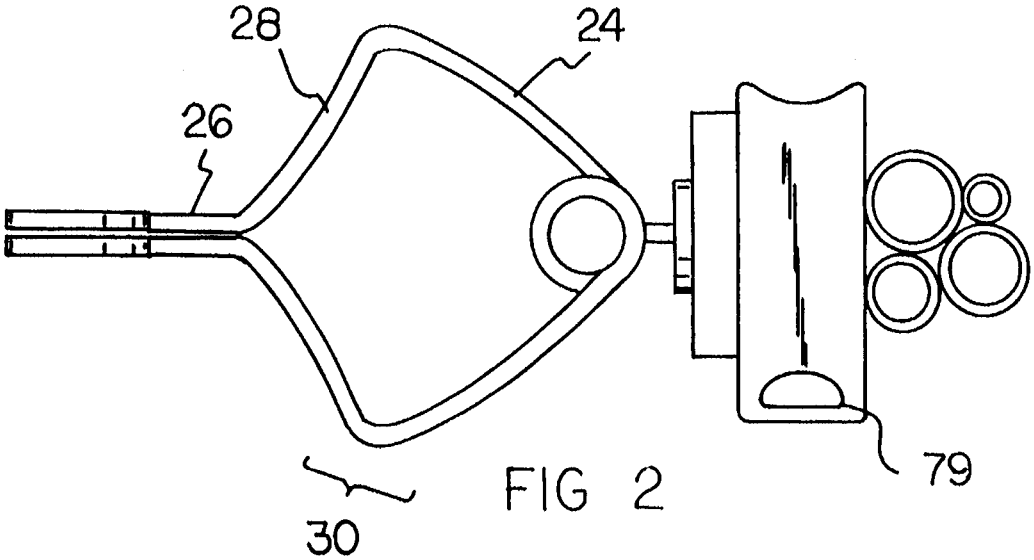
FIG. 2 is a side-elevational view of the preferred embodiment of the present invention.

With reference now to the drawings, and in particular, to FIG. 1 thereof, the preferred embodiment of the new and improved cigar/cigarette holder embodying the principles and concepts of the present invention and generally designated by the reference number 10 will be described.

The preferred embodiment of the present invention comprises a plurality of components. In their broadest context, such components include a clamp, container, and cigarette/cigar holding mechanism. Such components are individually configured and correlated with respect to each other to provide a structure that allows a user to temporarily secure a cigar 12 or a cigarette to a proximal object.

Specifically, the present invention includes a metallic clamp 20. The clamp has a pair of opposed arms 22 that are generally positioned in facing opposition about a common axis of symmetry. Each arm is formed of a wire. Each arm has an inboard segment 24 that extends away from the common axis of symmetry, an outboard segment 22 extending in parallel with the common axis of symmetry, and an intermediate segment 28 extended therebetween. The inboard segment and the intermediate segment of each arm in combination define a generally L-shaped configuration 30.

A pair of grasping ends 32 are also included as part of the clamp. Each grasping end is formed of a wire bent into a continuous and generally elliptical shape having major and minor axes. Each grasping end is coupled to one of the outboard segments 26 of one of the arms. The minor axis of each grasping end is positioned in axial alignment with the outboard segment 26 of the associated arm.

Positioned between the arms is a centrally disposed and circular spring 34. The spring has a first end 36 that is integral with the inboard segment of one of the arms and a second end 38 that is integral with the inboard segment of the other arm. The grasping ends of the clamp are offset from each other when a compressive force is applied to the ends 34, 36 to create a space for receiving an object to be held. The grasping ends 32 are additionally symmetrically aligned and placed in parallel facing contact with each other when the compressive force is removed.

In addition, the clamp includes a generally rectangular and box-shaped metal or plastic mounting block 40. The mounting block has four side surfaces as well as parallel and offset inboard and outboard surfaces 42, 44. A pin 50 is provided and has an outboard end 51 is affixed to and integral with the spring and an inboard end 52 with a generally T-shaped cross section that is pivotally secured within the mounting block 40 and held in place with a flashing 54 and screws 56. The pin in combination with the flashing allows axial rotation of the arms in unison about the common axis of symmetry.

A rigid rectangular and box-shaped plastic container 60 is used for holding smoking-related supplies. The container has a bottom wall 62 with an inboard wall 64, an outboard wall 66 and a pair of opposed side walls 68 coupled to and extended upwards from the bottom wall to define a hollow interior. A planar divider wall 70 is extended between the inboard and outboard walls to define a first compartment 72 sized for holding a cigarette lighter 73 and a second compartment 74 sized for holding a pack 75 of cigarettes. In addition, the second compartment can be sized for holding a plurality of unlit cigars. The container 60 has a concave-shaped upper edge extent 76 that defines a seat 78 upon which an individual cigar 12 or cigarette may be placed in a rest position. A first generally oval aperture 79 is formed in the side wall of the container adjacent to the first compartment at a lower extent thereof for draining fluids therefrom. Also included is a second generally oval aperture 81 formed in the side wall of the container adjacent to the second compartment at a lower extent thereof for draining fluids therefrom.

A cigarette/cigar holding mechanism 80 formed of a plurality of parallel and connected heat-resistant plastic tubes 82 is coupled to the outboard wall 66 of the container 60. The tubes each have a slightly different interior diameter. Each tube is adapted to snugly and removably hold an individual lit cigar or cigarette. Each tube may be split lengthwise to facilitate easy removal and insertion of a cigar or a cigarette. Preferably, four tubes are utilized. The tubes have ends aligned in parallel along one of the side walls of the container and also have slightly different lengths to accommodate different lengths of cigars and cigarettes. Lastly, a strip of pile-type fastener 86 is adhered to the outboard surface of the mounting block, and a complimentary strip of pile-type fastener 80 is adhered to the inboard wall of the container. The strips are removably secured to each other for removably coupling the container 60 to the clamp 20 at a desired orientation.

The present invention is designed to provide smokers with a convenient place to temporarily rest or secure a cigar, cigarette or pipe when performing activities such as playing golf, fishing or working outdoors. The present invention includes a clamp and a container. The container is used for holding a lighter, cigarette pack or unlit cigars. The clamp may be swiveled with respect to the container such that the container is upwardly oriented to allow its ready use. The present invention also includes several small tubes that are attached to the container. The tubes are sized to hold cigars and/or cigarettes. The container is formed of a heat resistant plastic or metal. The clamp, container, and holding mechanism of the present invention can be manufactured through injection molding and/or through assembly of component pieces. The present invention allows a cigar or cigarette to be held at a position such that it stays dry and is not inadvertently extinguished. The pile-type fastening system is designed to allow removal of the container from the clamp for cleaning. The present invention can be produced as a standard accessory for use when fishing or golfing. The present invention precludes the need for searching for dispersed lighters, cigars or cigarettes since they are held at a common proximal location for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A cigar/cigarette holder for allowing a user to temporarily secure a cigar or a cigarette to a proximal object comprising, in combination:

a clamp further comprising:

a pair of opposed arms positioned in facing opposition about a common axis of symmetry wherein each arm is formed of a wire and wherein each arm has an inboard segment extending away from the common axis of symmetry, an outboard segment extending in parallel with the common axis of symmetry, and an intermediate segment extended therebetween such that the inboard segment and the intermediate segment of each arm define a generally L-shaped configuration, a first and a second grasping end wherein each grasping end is formed of a wire bent into a continuous and generally elliptical shape and wherein each grasping end is coupled to one of the outboard segments of one of the arms, and a centrally disposed circular spring positioned between the arms, the spring having a first end integral with the inboard segment of one of the arms and a second end integral with the inboard segment of the other arm and with the grasping ends of the clamp being offset from each other when a compressive force is applied to the ends and with the grasping ends symmetrically aligned and placed in facing contact when the compressive force is removed, a rigid and generally rectangular box-shaped mounting block having parallel and offset inboard and outboard surfaces; and a pin having an outboard end affixed to the spring and an inboard end pivotally coupled to the inboard surface of the block to thereby allow axial rotation of the arms in unison about the common axis of symmetry;

a rigid rectangular box-shaped container having a bottom wall, an inboard wall, an outboard wall, and a pair of opposing side walls extended upwards from the bottom wall to define a hollow interior, a divider wall extended between the inboard and outboard walls to define a first compartment sized for holding a cigarette lighter and a second compartment sized for holding a pack of cigarettes or a plurality of unlit cigars, a first generally oval aperture formed in the side wall of the container adjacent to the first compartment at a lower extent thereof for draining fluids therefrom, a second generally oval aperture formed in the side wall of the container adjacent to the second compartment at a lower extent thereof for draining fluids therefrom, and a concave-shaped upper edge extent defining a seat upon which an individual cigar or cigarette may be placed;

a cigarette/cigar holding mechanism formed of a plurality of parallel and connected tubes coupled to the outboard wall of the container and wherein the tubes have slightly different interior diameters and wherein each tube is adapted to snugly and removably hold an individual lit cigar or cigarette; and a strip of pile-type fastener affixed to the outboard surface of the mounting block, and a complimentary strip of pile-type fastener affixed to the inboard wall of the container and with the strips removably secured to each other for removably coupling the container to the clamp.

2. A cigar/cigarette holder for allowing a user to temporarily secure a cigar or a cigarette to a proximal object comprising:

a clamp having a pair of arms positioned in opposition about a common axis of symmetry and spring means for biasing the arms toward each other;

a container for holding a plurality of cigars or cigarettes;

coupling means for removably coupling the container to the clamp and for allowing axial rotation of the arms about the common axis of symmetry; and a plurality of generally parallel and connected tubes coupled to the container for removably holding cigars or cigarettes.

3. The cigar/cigarette holder as set forth in claim 2:

wherein each arm is formed of a wire; and wherein each arm has an inboard segment extending away from the common axis of symmetry, an outboard segment extending in parallel with the common axis of symmetry, and an intermediate segment extended therebetween such that the inboard segment and the intermediate segment of each arm define a generally L-shaped configuration.

4. The cigar/cigarette holder as set forth in claim 2 wherein each arm of the clamp includes a grasping end formed of a wire with a continuous and generally elliptical shape.

5. The cigar/cigarette holder as set forth in claim 2 wherein the container has a bottom wall, an inboard wall, an outboard wall, and a pair of opposing side walls extended upwards from the bottom wall to define a hollow interior, and a divider wall extended between the inboard and outboard walls to define a first compartment and a second compartment.

6. The cigar/cigarette holder as set forth in claim 2 wherein the container includes a concave-shaped upper edge extent that defines a seat upon which an individual cigar or cigarette may be placed.

7. The cigar/cigarette holder as set forth in claim 2 wherein the tubes have slightly different interior diameters.

8. The cigar/cigarette holder as set forth in claim 2 and further comprising an aperture formed in the container at a lower extent thereof for draining fluids therefrom.

* * * * *